US008651089B2

(12) United States Patent
Anetsberger et al.

(10) Patent No.: US 8,651,089 B2
(45) Date of Patent: Feb. 18, 2014

(54) INJECTION SYSTEM FOR AN INTERNAL COMBUSTION ENGINE

(75) Inventors: Daniel Anetsberger, Teugn (DE); Andrej Astachow, Regensburg (DE); Christoph Klesse, Wörth A.D. Donau (DE)

(73) Assignee: Continental Automotive GmbH, Hannover (DE)

( * ) Notice: Subject to any disclaimer, the term of this patent is extended or adjusted under 35 U.S.C. 154(b) by 288 days.

(21) Appl. No.: 13/127,635

(22) PCT Filed: Oct. 19, 2009

(86) PCT No.: PCT/EP2009/063660

§ 371 (c)(1), (2), (4) Date: Jul. 11, 2011

(87) PCT Pub. No.: WO2010/052120

PCT Pub. Date: May 14, 2010

(65) Prior Publication Data

US 2011/0259300 A1 Oct. 27, 2011

(30) Foreign Application Priority Data

Nov. 5, 2008 (DE) ..... 10 2008 055 935

(51) Int. Cl.
*F02M 33/08* (2006.01)

(52) U.S. Cl.
USPC ..... 123/447; 123/456; 123/514

(58) Field of Classification Search
USPC ..... 123/447, 456, 457, 461, 510, 511, 514
See application file for complete search history.

(56) References Cited

U.S. PATENT DOCUMENTS 6,058,912 A * 5/2000 Rembold et al. ..... 123/516
6,792,915 B2 * 9/2004 Rembold et al. ..... 123/446
7,219,654 B2 * 5/2007 Ludwig et al. ..... 123/446

(Continued)

FOREIGN PATENT DOCUMENTS

CN 1961145 A 5/2007 ..... F02M 55/00
DE 10343482 A1 4/2005 ..... F02M 37/18

(Continued)

OTHER PUBLICATIONS

International Search Report and Written Opinion for Application No. PCT/EP2009/063660 (14 pages), Feb. 10, 2010.

(Continued)

*Primary Examiner* — Hai Huynh
(74) *Attorney, Agent, or Firm* — King & Spalding L.L.P.

(57) ABSTRACT

An injection system for an internal combustion engine has a prefeed pump for delivering fuel from a fuel tank, a high pressure pump for delivering the fuel to a fuel accumulator arranged downstream of the prefeed pump, an accumulator return line arranged downstream of the fuel accumulator and used to return the fuel from the fuel accumulator to the fuel tank, and a valve arranged in the accumulator return line and by which the fuel can be optionally supplied to the fuel tank or to a tank bypass line which hydraulically leads to a point between the prefeed pump and the high pressure pump. A pressure relief valve is arranged in the accumulator return line downstream of the valve and upstream of the fuel tank. The pressure relief valve is suitably designed to allow adjustment of a fuel pressure in the accumulator return line upstream of the pressure relief valve.

20 Claims, 1 Drawing Sheet

(56) References Cited

U.S. PATENT DOCUMENTS

| | | | | |
|---|---|---|---|---|
| 7,574,994 | B2 | 8/2009 | Scheurer et al. | 123/447 |
| 7,832,374 | B2 * | 11/2010 | Verner et al. | 123/446 |
| 8,312,862 | B2 * | 11/2012 | Klesse et al. | 123/446 |
| 8,371,267 | B2 * | 2/2013 | Kristen et al. | 123/446 |
| 8,434,459 | B2 * | 5/2013 | Yudanov | 123/514 |
| 2002/0124834 | A1 * | 9/2002 | Rembold et al. | 123/514 |
| 2004/0007214 | A1 | 1/2004 | Schmidl et al. | F02M 1/00 |
| 2012/0080010 | A1 * | 4/2012 | Nistler et al. | 123/456 |

FOREIGN PATENT DOCUMENTS

| | | | | |
|---|---|---|---|---|
| DE | 102007059851 | A1 | 6/2009 | F02M 37/00 |
| EP | 1296060 | B1 | 6/2005 | F02M 37/00 |
| WO | 2005/038236 | A1 | 4/2005 | F02M 37/18 |
| WO | 2010/052120 | A1 | 5/2010 | F02M 55/00 |

OTHER PUBLICATIONS

Chinese Office Action, Application No. 200980144022.2, 13 pages, Dec. 3, 2012.

* cited by examiner

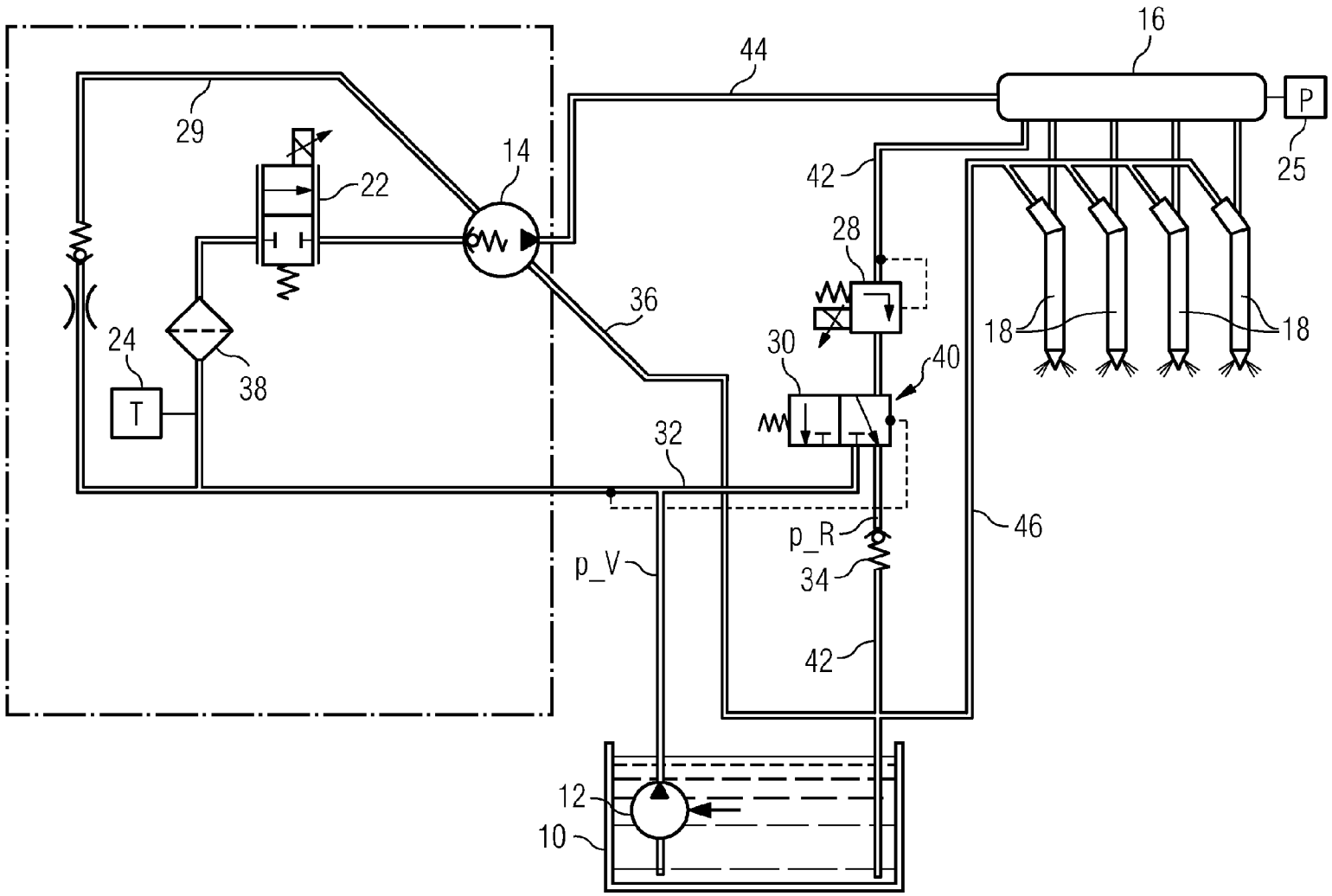
P
25
16
18
18
46
40
28
42
30
p_R
34
42
44
32
36
p_V
12
10
14
22
38
29
24
T

INJECTION SYSTEM FOR AN INTERNAL COMBUSTION ENGINE

CROSS-REFERENCE TO RELATED APPLICATIONS

This application is a U.S. National Stage Application of International Application No. PCT/EP2009/063660 filed Oct. 19, 2009, which designates the United States of America, and claims priority to German Application No. 10 2008 055 935.0 filed Nov. 5, 2008, the contents of which are hereby incorporated by reference in their entirety.

TECHNICAL FIELD

The invention relates to an injection system for an internal combustion engine.

BACKGROUND

Injection systems are used to inject fuel into combustion chambers of an internal combustion engine, in particular a diesel internal combustion engine, which injection systems have been increasingly configured in the last years as what are known as "common rail" systems. In the latter, the injectors which are arranged in the combustion chambers are supplied with fuel from a common fuel accumulator, the common rail. Here, the fuel which is to be injected is present in the fuel accumulator at a pressure of up to over 2000 bar.

Injection systems for internal combustion engines usually have various pumps, by means of which fuel is conveyed, in order to be introduced into combustion chambers of the internal combustion engine. Injection systems of this type for internal combustion engines make high requirements of the accuracy of the injection pressure which is required for the injection of the fuel into the combustion chambers of the internal combustion engine.

This is particularly important, since more and more stringent legal regulations are being passed with regard to the permissible pollutant emissions of internal combustion engines which are arranged in motor vehicles. Said legal regulations make it necessary to take various measures, by which the pollutant emissions are reduced. Thus, for example, the formation of soot is greatly dependent on the preparation of the air/fuel mixture in the respective cylinder of the internal combustion engine. Here, it is advantageous for the reduction in the pollutant emissions if the fuel can be injected very precisely into the cylinder.

EP 1 296 060 B1 has disclosed an injection system for an internal combustion engine, having a prefeed pump, by way of which fuel can be conveyed out of a fuel tank to the suction side of a high pressure pump. A high pressure pump which is connected hydraulically behind the prefeed pump then conveys fuel into a fuel accumulator, from where it can then be distributed to injectors which are coupled hydraulically to the fuel accumulator. In the case of a suitable actuation of the high pressure pump, a predefined pressure which is dependent on the operating parameters of the internal combustion engine can be reached in the fuel accumulator.

SUMMARY

According to various embodiments, an injection system for an internal combustion engine can be provided, by way of which injection system precise and reliable metering of fuel for the internal combustion engine and a simple construction of the injection system are made possible in a simple way.

According to an embodiment, an injection system for an internal combustion engine, may comprise: a prefeed pump for conveying fuel out of a fuel tank, a high pressure pump which is arranged downstream of the prefeed pump for conveying the fuel into a fuel accumulator, an accumulator return line which is arranged downstream of the fuel accumulator and by way of which fuel can be returned from the fuel accumulator into the fuel tank, and a valve which is arranged in the accumulator return line and by means of which the fuel can optionally be fed to the fuel tank or a tank bypass line which opens hydraulically between the prefeed pump and the high pressure pump, wherein a pressure limiting valve is arranged in the accumulator return line downstream of the valve and upstream of the fuel tank, and it being possible to set a fuel pressure in the accumulator return line upstream of the pressure limiting valve by a suitable configuration of the pressure limiting valve.

According to a further embodiment, the pressure limiting valve can be configured in such a way that the fuel pressure in the accumulator return line upstream of the pressure limiting valve corresponds approximately to a prefeed pressure of the fuel which the prefeed pump provides on the outlet side.

BRIEF DESCRIPTION OF THE DRAWINGS

Various embodiments are explained in greater detail in the following text using the diagrammatic drawing.

The single FIGURE shows a block circuit diagram of an injection system for an internal combustion engine.

DETAILED DESCRIPTION

According to various embodiments, an injection system for an internal combustion engine has a prefeed pump for conveying fuel out of a fuel tank, a high pressure pump which is arranged downstream of the prefeed pump for conveying the fuel into a fuel accumulator, an accumulator return line which is arranged downstream of the fuel accumulator and by way of which fuel can be returned from the fuel accumulator into the fuel tank, and a valve which is arranged in the accumulator return line and by means of which the fuel can optionally be fed to the fuel tank or a tank bypass line which opens hydraulically between the prefeed pump and the high pressure pump. A pressure limiting valve is arranged in the accumulator return line downstream of the valve and upstream of the fuel tank. A fuel pressure can be set in the accumulator return line upstream of the pressure limiting valve by a suitable configuration of the pressure limiting valve.

This is advantageous, since largely constant pressure conditions can thus be achieved in the accumulator return line upstream of the valve, by means of which the fuel can optionally be fed to the fuel tank or to the tank bypass line, substantially independently of the switching position of said valve. For example, a pressure regulating valve can thus be operated with high accuracy, which valve serves to regulate the pressure in the fuel accumulator and is arranged in the accumulator return line downstream of the fuel accumulator and upstream of the valve, by means of which the fuel can optionally be fed to the fuel tank or to the tank bypass line.

Said pressure regulating valve can therefore be operated on a defined characteristic curve in all relevant operating states. Simple calibration of the pressure regulating valve is therefore possible. The fuel which is discharged via the accumulator return line can optionally be mixed into the inlet of the high pressure pump or returned into the tank by means of the valve as a function of the temperature of said fuel.

In one embodiment, the pressure limiting valve is configured in such a way that a fuel pressure in the accumulator return line upstream of the pressure limiting valve corresponds approximately to a prefeed pressure of the fuel which the prefeed pump provides on the outlet side. The pressure regulating valve can therefore advantageously be operated on a largely identical characteristic curve for all relevant operating states.

The injection system (shown in the FIGURE) for an internal combustion engine has a fuel tank 10, out of which fuel is conveyed by means of a prefeed pump 12. The prefeed pump 12 is preferably configured as a vane cell pump. However, another pump type can also be used, for example a gearwheel pump or a gerotor pump for the prefeed. The prefeed pump 12 can be driven mechanically by way of a drive shaft (not shown) which is coupled fixedly to an engine shaft of the internal combustion engine. As an alternative, it is also possible, however, to use an electrically operated prefeed pump 12, as a result of which it is possible to control the delivery performance of the prefeed pump 12 independently of the delivery performance of further pumps. In the embodiment which is shown here, the prefeed pump 12 is what is known as an in-tank pump; that is to say, it is arranged inside the fuel tank 10 and is preferably configured as an immersion pump.

The prefeed pump 12 is hydraulically coupled on the outlet side to a primary pressure control valve, by which, if a predefined prefeed pressure p_V is exceeded on the output side of the prefeed pump 12, a part of the fuel which is conveyed by the prefeed pump 12 can be returned to the intake side of the prefeed pump 12 and therefore the prefeed pressure p_V on the outlet side of the prefeed pump 12 can be kept largely constant.

A high pressure pump 14 for conveying the fuel into a fuel accumulator 16 is arranged downstream of the prefeed pump. The fuel accumulator 16 is hydraulically coupled to the high pressure pump 14 via a fuel accumulator feed line 44. The high pressure pump 14 can preferably be configured as a radial piston pump or as an in-line piston pump having a plurality of cylinder units, as are known for use in injection systems of internal combustion engines.

Furthermore, the fuel accumulator 16 is hydraulically coupled via lines to an injector 18 or a plurality of injectors 18. Each of the injectors 18 is assigned a combustion chamber of the internal combustion engine and each injector 18 can be actuated in such a way that fuel is injected into the combustion chamber.

The fuel which is to be injected into combustion chambers of the internal combustion engine by means of the injectors 18 can reach a relatively high injection pressure by way of the high pressure pump 14.

Excess fuel can be returned from the injectors 18 via an injector return line 46 back to the fuel tank 10.

A volumetric flow control valve 22, by way of which the fuel flow can be set from the prefeed pump 12 into the high pressure pump 14, is arranged hydraulically between the prefeed pump 12 and the high pressure pump 14. A temperature sensor 24 is arranged hydraulically between the prefeed pump 12 and the volumetric flow control valve 22. By means of the temperature sensor 24 and a pressure sensor 25, by way of which the fuel pressure in the fuel accumulator 16 can be determined, and optionally as a function of further input variables, the volumetric flow control valve 22 can be actuated in such a way that low pressure-side control of the fuel flow which is fed to the high pressure pump 14 is possible.

The fuel accumulator 16 is connected by means of an accumulator return line 42 to a pressure regulating valve 28 which can be actuated, for example, as a function of the fuel pressure which is determined by the pressure sensor 25 in the fuel accumulator 16. If a predefined fuel pressure is exceeded in the fuel accumulator 16, the pressure regulating valve 28 can open and a part of the fuel which is conveyed by the high pressure pump 14 can be returned via the accumulator return line 42 back into the fuel tank 10.

A flushing line 29 which opens on the outlet side into the housing of the high pressure pump 14 branches off downstream of the prefeed pump 12, with the result that it is possible to flush the housing of the high pressure pump 14 with fuel during operation. Cooling and lubrication of the high pressure pump 14 can therefore be brought about. The fuel which is used for flushing purposes can subsequently be returned from the housing of the high pressure pump 14 via a flushing return line 36 back into the fuel tank 10.

Furthermore, a flushing line valve and, hydraulically in series thereto, a flushing line throttle are arranged in the flushing line 29. The flushing line throttle can restrict the fuel flow through the flushing line 29. The fuel flow which branches off via the flushing line 29 can be released by the flushing line valve if the prefeed pressure p_V on the outlet side of the prefeed pump 12 exceeds a predefined value. In order to protect against particles which are entrained in the fuel flow or in order to separate water, a filter 38 is arranged upstream of the prefeed pump 12. The temperature sensor 24, by way of which a temperature can be determined which is representative of the filter 38, is arranged in the filter 38 or in its surroundings.

The flushing return line 36, the accumulator return line 42 and the injector return line 46 are preferably routed back to the fuel tank 10.

A tank bypass line 32 branches off from the accumulator return line 42 at a branching point 40 downstream of the pressure regulating valve 28 and upstream of the fuel tank 10. By means of a valve 30 which is arranged at the branching point 40, the fuel which flows back from the fuel accumulator 16 can be conducted back to the filter 38 via the tank bypass line 32, bypassing the fuel tank 10, or further via the accumulator return line 42 to the fuel tank 10.

A pressure limiting valve 34, by way of which a fuel pressure p_R can be set in the accumulator return line 42 upstream of the pressure limiting valve 34, is arranged in the accumulator return line 42 downstream of the valve 30 and upstream of the fuel tank 10. The pressure limiting valve 34 is preferably configured as a spring-loaded nonreturn valve. The pressure limiting valve 34 is preferably dimensioned in such a way that the fuel pressure p_R in the accumulator return line 42 upstream of the pressure limiting valve 34 corresponds approximately to the prefeed pressure p_V of the fuel at the outlet of the prefeed pump 12. In the following text, the function of the injection system is to be described briefly:

The prefeed pump 12 conveys fuel out of the fuel tank 10. The fuel is at the prefeed pressure p_V at the outlet of the prefeed pump 12. The fuel then passes via the temperature sensor 24 and the filter 38 to the volumetric flow control valve 22. As much fuel as is required by the fuel accumulator is made available to the high pressure pump 14 by the volumetric flow control valve 22. The fuel is delivered by means of the high pressure pump 14 via the fuel accumulator feed line 44 to the fuel accumulator 16. From the fuel accumulator 16, the fuel is fed to the injectors 18, and is injected by the latter into the combustion chambers of the internal combustion engine.

The fuel pressure which is required for the fuel accumulator is fixed by the pressure regulating valve 28 in the accumulator return line 42. If the pressure rises too much in the fuel accumulator 16 or if the pressure in the fuel accumulator 16 is to be reduced in a targeted manner, fuel can be released from the fuel accumulator 16 by means of the pressure regulating valve 28 via the accumulator return line 42.

The fuel which is discharged via the accumulator return line can optionally be mixed into the feed line of the high pressure pump 14 or can be conducted back into the fuel tank 10 by means of the valve 30 as a function of the temperature of said fuel. Moreover, fuel out of the flushing return line 36 and the return line 46 from the injectors is conducted back into the fuel tank 10.

If the filter 38 is to be heated, for example when the internal combustion engine is being started up, the valve 30 assumes a position, in which the fuel flow is released from the fuel accumulator 16 via the accumulator return line 42 and the tank bypass line 48 to the fuel filter 36, with the result that the heated fuel can pass to the filter 38.

When the valve is sufficiently warm, the valve 30 can switch over and release the fuel flow from the accumulator return line 42 via the pressure limiting valve 34 to the fuel tank 10.

If the pressure limiting valve 34 is selected in such a way that the fuel pressure p_R in the accumulator return line 42 upstream of the pressure limiting valve 34 corresponds largely to the prefeed pressure p_V of the fuel at the outlet of the prefeed pump 12, largely constant pressure conditions can be maintained in the accumulator return line 42 upstream of the valve 30 substantially independently of the switching position of the valve 30. Since, in this case, no substantial pressure fluctuations occur in the accumulator return line 42 upstream of the valve 30, the pressure regulating valve 28 which serves to regulate the pressure in the fuel accumulator 16 and is arranged in the accumulator return line 42 downstream of the fuel accumulator 16 and upstream of the valve 30 can be operated on a defined characteristic curve with high accuracy in the relevant operating states. Simple and inexpensive calibration of the pressure regulating valve 28 is therefore also possible.

The invention claimed is:

1. An injection system for an internal combustion engine, having a prefeed pump for conveying fuel out of a fuel tank, a high pressure pump which is arranged downstream of the prefeed pump for conveying the fuel into a fuel accumulator, an accumulator return line which is arranged downstream of the fuel accumulator and by way of which fuel can be returned from the fuel accumulator into the fuel tank, and a valve which is arranged in the accumulator return line and by means of which the fuel can optionally be fed to the fuel tank or a tank bypass line which opens hydraulically between the prefeed pump and the high pressure pump, wherein a pressure limiting valve being arranged in the accumulator return line downstream of the valve and upstream of the fuel tank, and a fuel pressure in the accumulator return line upstream of the pressure limiting valve can be set by a suitable configuration of the pressure limiting valve.

2. The injection system according to claim 1, in which the pressure limiting valve is configured in such a way that the fuel pressure in the accumulator return line upstream of the pressure limiting valve corresponds approximately to a prefeed pressure of the fuel which the prefeed pump provides on the outlet side.

3. The injection system according to claim 1, wherein the prefeed pump is a vane cell pump.

4. The injection system according to claim 1, wherein the prefeed pump is a gearwheel pump or a gerotor pump.

5. The injection system according to claim 1, wherein the prefeed pump is driven mechanically by way of a drive shaft which is coupled fixedly to an engine shaft of the internal combustion engine.

6. The injection system according to claim 1, wherein the prefeed pump is electrically operated.

7. The injection system according to claim 1, wherein the prefeed pump is arranged inside the fuel tank.

8. The injection system according to claim 1, wherein the high pressure pump is a radial piston pump or as an in-line piston pump having a plurality of cylinder units.

9. The injection system according to claim 1, further comprising a temperature sensor being arranged hydraulically between the prefeed pump and the valve.

10. The injection system according to claim 9, further comprising a pressure sensor which in combination with the temperature sensor is operable to determine the fuel pressure in the fuel accumulator.

11. The injection system according to claim 1, further comprising a flushing line branching off downstream of the prefeed pump for flushing a housing of the high pressure pump with fuel during operation.

12. The injection system according to claim 11, further comprising a flushing line valve and, hydraulically in series thereto, a flushing line throttle arranged in the flushing line.

13. The injection system according to claim 9, further comprising a filter arranged upstream of the prefeed pump.

14. The injection system according to claim 13, wherein the temperature sensor is arranged in the filter or in its surroundings.

15. An method for operating an injection system for an internal combustion engine, comprising providing a prefeed pump for conveying fuel out of a fuel tank, arranging a high pressure pump which downstream of the prefeed pump for conveying the fuel into a fuel accumulator, arranging an accumulator return line downstream of the fuel accumulator and by way of which fuel can be returned from the fuel accumulator into the fuel tank, arranging a valve which in the accumulator return line, and controlling the valve to optionally feed the fuel to the fuel tank or a tank bypass line which opens hydraulically between the prefeed pump and the high pressure pump, and configuring a pressure limiting valve being arranged in the accumulator return line downstream of the valve and upstream of the fuel tank to set a fuel pressure in the accumulator return line upstream of the pressure limiting valve.

16. The method according to claim 15, further comprising configuring the pressure limiting valve in such a way that the fuel pressure in the accumulator return line upstream of the pressure limiting valve corresponds approximately to a prefeed pressure of the fuel which the prefeed pump provides on the outlet side.

17. The method according to claim 15, further comprising arranging a temperature sensor between the prefeed pump and the valve.

18. The method according to claim 17, further comprising determining the fuel pressure in the fuel accumulator by means of a pressure sensor in combination with the temperature sensor.

19. The method according to claim 15, further comprising flushing a housing of the high pressure pump with fuel during operation by means of a flushing line branching off downstream of the prefeed pump.

20. The method according to claim 15, further comprising filtering the fuel by a filter arranged upstream of the prefeed pump in order to protect against particles which are entrained in a fuel flow or in order to separate water from said fuel.

* * * * *